United States Patent [19]

Smith et al.

[11] Patent Number: 4,570,370

[45] Date of Patent: Feb. 18, 1986

[54] WIDE ANGLED GUN MAGAZINE ENTRANCE GUIDE OPENING

[76] Inventors: Alan K. Smith, 211 Betty Dr., Richardson, Tex. 75081; Stephen R. Alexander, 814 Scottsdale Dr., Richardson, Tex. 75080

[21] Appl. No.: 588,394

[22] Filed: Mar. 12, 1984

[51] Int. Cl.[4] ..... F41C 27/00

[52] U.S. Cl. ..... 42/90; 42/7; 42/71 P

[58] Field of Search ..... 42/7, 90, 71 P

[56] References Cited

U.S. PATENT DOCUMENTS 3,069,976 12/1962 Stevens, Jr. ..... 42/7

3,999,321 12/1976 Musgrave ..... 42/7

*Primary Examiner*—Charles T. Jordan

*Attorney, Agent, or Firm*—Warren H. Kintzinger

[57] ABSTRACT

A guide for the insertion of gun magazines that is an extension of a pistol mainspring housing with a wide angled bifurcated opening making it easier and faster to insert fresh magazine clips into the gun receiver. This guide extension that is quite useful for pistols such as the Colt Government Model pistols advantageously also lengthens the pistol grip enhancing stability of the gun in hand.

10 Claims, 6 Drawing Figures

FIG. 1
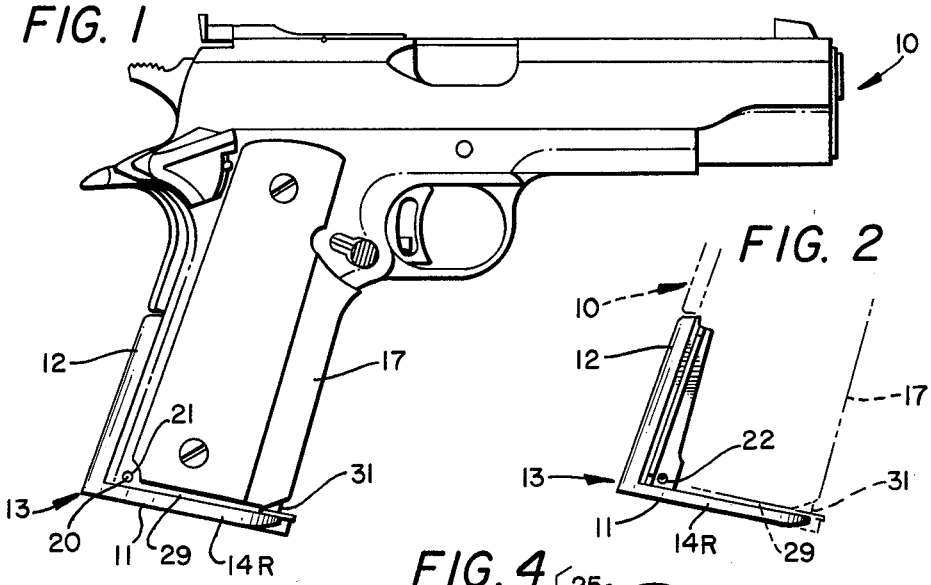
FIG. 2
FIG. 3
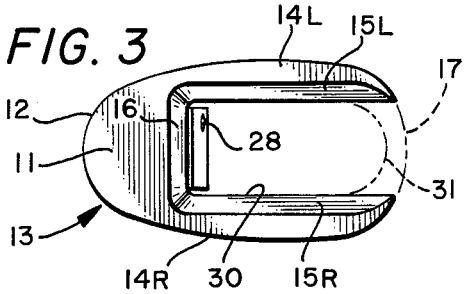
FIG. 4
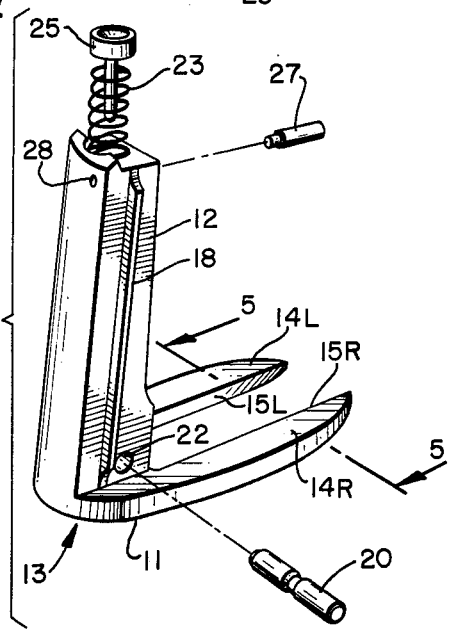
FIG. 5
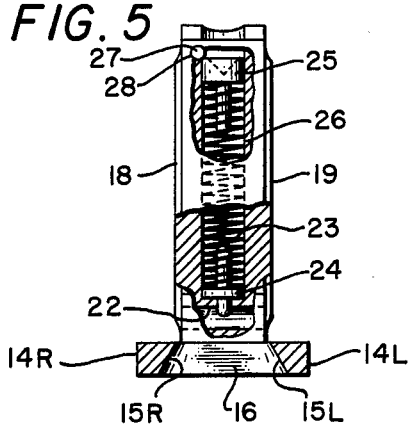
FIG. 6
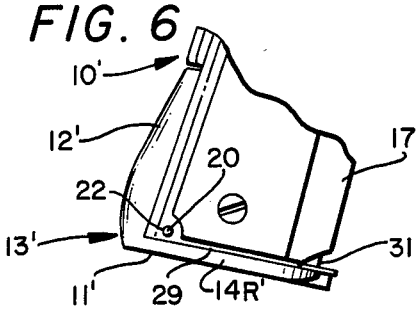

WIDE ANGLED GUN MAGAZINE ENTRANCE GUIDE OPENING

This invention relates in general to gun magazine entrance and grip structures, and more particularly, to a wide angled bifurcated opening magazine entrance guide extension of a pistol mainspring housing that also lengthens the pistol grip.

Magazine insertion in the receiver of pistol grips is many times more difficult and slower than desired particularly under a stress situation such as in target shooting matches, law enforcement or military use. Further, through periods of rapid shooting with repeated insertion of fresh magazine clips it is important that the hand grip of the gun be stabilized for enhanced accuracy of shooting repeated rounds. These factors are enhanced if the gun grip is lengthened and the magazine receiver is provided with a wide angled guide mouth opening for guiding fresh magazine cartridge clips into the gun receiver without catch, hang up or binding. It is also important that the basic gun not be so altered that it can not be restored to its original factory state.

It is therefore a principal object of this invention to provide an improved magazine insertion guide to a gun receiver.

Another object is to provide such an improved magazine insertion guide that beneficially, via lengthening of the gun hand grip, enhances stability in holding of the gun.

A further object is to improve ease and speed of fresh magazine insertion in a gun receiver.

Still another object is to eliminate gun magazine insertion catch, hang up or insert binding as magazines are being changed in a gun.

Features of the invention useful in accomplishing the above objects include, in a wide angled gun magazine entrance guide opening equipped extension at the bottom of a gun grip, a bifurcated opening equipped extension from a pistol mainspring housing extending over the bottom of the gun grip with the opening a wide angled opening aligned with the receiver opening within the gun grip. With the opening extension from the pistol mainspring housing extending over the bottom of the gun grip it in effect is also beneficial extension of the grip helping to stabilize the gun held in the hand. Further, the extension of the grip and provision of the wide angled gun magazine receiver entrance guide is provided with a pistol mainspring housing in a unitary structure mounted on a pistol the same as with a stock mainspring housing without any machining alteration of the basic stock pistol.

A specific embodiment representing what is presently regarded as the best mode of carrying out the invention is illustrated in the accompanying drawing.

In the drawing:

FIG. 1 represents the right hand side elevation view of a Colt "45" semi automatic pistol with a magazine entrance guide open extension equipped pistol mainspring housing;

FIG. 2, a right hand side elevation view of a unitary mainspring housing and magazine entrance guide opening extension;

FIG. 3, a bottom plan view of the unitary mainspring housing and magazine entrance guide opening extension;

FIG. 4, a perspective view of the unitary mainspring housing and magazine entrance guide opening extension in a partially disassembled exploded state;

FIG. 5, a partially cut away and sectioned view of the unitary housing and magazine entrance guide opening extension taken partially from line 5—5; and FIG. 6, a partial right hand side elevation view of the grip lower end of a semi automatic pistol with another unitary mainspring housing and magazine entrance guide opening extension.

Referring to the drawing:

The semi automatic pistol 10 of FIG. 1 is shown to be equipped with a magazine receiver entrance guide opening extension 11 from the pistol mainspring housing 12 that are joined together as a unitary structure 13 shown also in FIGS. 2–5. The opening extension 11 is in the form of a bifurcated extension from the bottom of mainspring housing portion 12 of structure 13 with forward extending arms 14R and 14L extending from the lowered bottom of mainspring housing 12. The opening defined by arms 14R and 14L and the mainspring housing 12 has downward facing (or angled) surfaces 15R and 15L interconnected joined by beveled (or angled) surface 16. The unitary structure 13 is mounted on the grip 17 (or butt) of the pistol 10 containing the magazine receiver with the mainspring housing portion 12 thereof mounted in the pistol grip 17 with opposite side flanges 18 and 19 received and held in internal retaining grooves (detail not shown) in the grip 17 just as with a stock mainspring housing. Further, the unitary structure is held in place with the main spring housing pin 20 pressed in place through openings 21 in the grip 17 and opening 22 through mainspring housing 12. Thus, the pistol 10 is in its original unaltered state other than unitary structure 13 with an integral mainspring housing 12 being mounted on the pistol grip 17 in the same manner as, and in place of, a standard stock mainspring housing.

The mainspring housing 12 of unitary structure 13 holds a main spring 23 between pin retainer 24 at the bottom and cap 25 within housing opening 26 as restrained in place by main spring cap pin 27 extended through housing opening 28. The forward extended arms 14R and 14L of the extension 11 underlie the bottom 29 of grip 17 and have a tolerance spacing therefrom to accomodate interchangeability of the unitary structure 13 to any of the stock pistols of a particular mass produced model. Arms 14R and 14L are so spaced as to be in alignment with opposite sides of the magazine receiver opening 30. The beveled surfaces 15R and 15L of the arms 14R and 14L and the beveled surface 16 interconnecting beveled surfaces 15R and 15L are all angled toward the magazine receiver opening 30 so as to guide a magazine 31 being moved toward the opening 30 smoothly and easily into the opening for easy and fast smooth insertion of magazines 31 into the receiver opening 30 in the grip 17 of pistol 10. The opening extension 11 from the pistol mainspring housing 12 is also, in effect, an extension of the grip 17 helping to stabilize the gun in the hand through periods of rapid shooting with repeated insertion of fresh magazines 31 for enhanced accuracy of shooting repeated rounds.

The mainspring housing 12 in the embodiment of FIGS. 1–5 is substantially straight backed in vertical orientation through the back of the opening extension 11 as is preferred by many people in holding a pistol 10. There are some, however, who prefer an arched backed mainspring housing 12' such as shown in the embodiment of FIG. 6 with the arched curvature extending down through the opening extension 11' in a unitary structure 13'. The other structural features and components with this embodiment are essentially the same, if not the same, as with their counterparts in the embodiment of FIGS. 1–5 and with identification numbers carrying primes the function is the same as with the other embodiment.

Whereas this invention has been described with respect primarily to two embodiments thereof, it should be realized that various changes may be made without departing from the essential contributions to the art made by the teachings hereof.

We claim:

1. A wide angled gun magazine entrance guide for easier and faster insertion of fresh magazines into a gun receiver comprising: extension means integral with a gun mainspring housing mounted on the back of a gun grip; said extension means being formed with a bifurcated two arm portion extending forwardly from the reward bottom extension of said gun mainspring housing; said bifurcated two arm portion underlying the bottom of the gun grip with said arms so spaced as to be in alignment with opposite sides of the gun magazine receiver opening; and wherein said arms of said two arm portion have downward facing beveled surfaces angled toward the magazine receiver opening so as to guide a magazine being moved toward the opening from below smoothly and easily into the opening for easy and fast smooth insertion of magazines into the gun receiver opening.

2. The wide angled gun magazine entrance guide of claim 1, wherein said rearward bottom extension of said gun mainspring housing is formed with a downward facing beveled surface angled toward the back of the magazine receiver opening and interconnecting said downward facing beveled surface of said two arms.

3. The wide angled gun magazine entrance guide of claim 2, wherein said rearward bottom extension of said gun mainspring housing extends the grip of the gun to stabilize the gun in the hand through periods of shooting with insertion of fresh magazines for enhanced accuracy of shooting repeated rounds.

4. The wide angled gun magazine entrance guide of claim 3, wherein said magazine entrance guide and gun mainspring housing as an integral unit is mounted on a gun grip identically the same as a standard stock mainspring housing.

5. The wide angled gun magazine entrance guide of claim 4, wherein said bifurcated two arm portion underlies the bottom of the gun grip with clearance tolerance spacing accomodating interchangeability mounting of the unitary structure to any of the stock pistols of a particular mass produced model.

6. The wide angled gun magazine entrance guide of claim 5, wherein the back of said unitary structure through the mainspring housing portion and the rearward bottom extension thereof is substantially straight backed in vertical orientation throughout the vertical length thereof.

7. The wide angled gun magazine entrance guide of claim 5, wherein the back of said unitary structure through the mainspring housing portion and the rearward bottom extension thereof is arch backed in vertical orientation throughout the vertical length thereof.

8. The wide angled gun magazine entrance guide of claim 5, wherein said bifurcated two arm portion of said extension means is open at the forward end to prevent contact of the front of magazine held rounds with magazine entrance guide structure.

9. The wide angled gun magazine entrance guide of claim 5, wherein said bifurcated two arm portion of said extension means is open sufficiently to permit seating of a magazine inserted into the gun grip receiver just the same as if the bifurcated two arm portion of said extension means were not in place with said unitary structure mounted on a gun grip.

10. The wide angled gun magazine entrance guide of claim 9, wherein said gun mainspring housing and magazine entrance guide as an integral unit adds weight to the gun in hand and thereby reduces firing recoil impact.

* * * * *